US008661658B2

(12) United States Patent
Kapelski

(10) Patent No.: US 8,661,658 B2
(45) Date of Patent: Mar. 4, 2014

(54) LASHING PLATFORM HAVING A MAGAZINE FOR TWISTLOCKS

(75) Inventor: Rainer Michael Jörg Kapelski, Böel (DE)

(73) Assignee: Kalp GmbH, Boel (DE)

( * ) Notice: Subject to any disclaimer, the term of this patent is extended or adjusted under 35 U.S.C. 154(b) by 161 days.

(21) Appl. No.: 13/381,443

(22) PCT Filed: May 26, 2010

(86) PCT No.: PCT/DE2010/000575

§ 371 (c)(1),
(2), (4) Date: Mar. 13, 2012

(87) PCT Pub. No.: WO2011/000336

PCT Pub. Date: Jan. 6, 2011

(65) Prior Publication Data

US 2012/0167382 A1 Jul. 5, 2012

(30) Foreign Application Priority Data

Jun. 30, 2009 (DE) ..... 10 2009 031 272

(51) Int. Cl.
*B23Q 7/10* (2006.01)

(52) U.S. Cl.
USPC ..... 29/809; 29/787; 29/785; 29/709; 29/426.3; 29/464; 29/525

(58) Field of Classification Search
USPC ..... 29/809, 787, 785, 773, 771, 714, 709, 29/525.08, 426.5–426.6, 426.3, 426.1; 410/82; 294/81.53
See application file for complete search history.

(56) References Cited

U.S. PATENT DOCUMENTS

| | | | | |
|---|---|---|---|---|
| 6,554,557 | B1 * | 4/2003 | Takehara et al. | 414/140.3 |
| 6,688,249 | B1 * | 2/2004 | Klein Breteler et al. | 114/75 |
| 7,779,604 | B2 * | 8/2010 | Kapelski | 53/77 |
| 8,056,217 | B2 * | 11/2011 | Hay | 29/700 |
| 2006/0115350 | A1 * | 6/2006 | Weis | 414/139.4 |
| 2008/0286074 | A1 * | 11/2008 | Chellappa et al. | 414/140.3 |

FOREIGN PATENT DOCUMENTS

| | | | | |
|---|---|---|---|---|
| DE | 4317996 | A1 * | 12/1994 | B63B 25/28 |
| DE | 10301197 | | 8/2004 | |
| DE | 102006015807 | | 9/2007 | |
| WO | WO 2006/024071 | | 3/2006 | |
| WO | WO 2007/021246 | | 2/2007 | |
| WO | WO 2007/098749 | | 9/2007 | |

* cited by examiner

*Primary Examiner* — Alexander P Taousakis
*Assistant Examiner* — Matthew P Travers
(74) *Attorney, Agent, or Firm* — Diederiks & Whitelaw, PLC

(57) ABSTRACT

A lashing platform includes a base frame, a setting plate resiliently supported on the base frame, a plurality of screwing devices for inserting twistlocks into container fittings or removing twistlocks from container fittings, a plurality of magazines for accommodating the twistlocks, and a plurality of transfer devices for transferring a twistlock from a magazine to a screwing device or from a screwing device to a magazine. The lashing platform being characterized by at least two units, which are each formed by at least two screwing devices, at least one transfer device, and at least one magazine and which can be moved relative to each other in the longitudinal direction of the lashing platform within the base frame, at least one drive for moving the units, and a controller for moving the units into positions in which the screwing devices have access to the container fittings of containers of different size.

19 Claims, 8 Drawing Sheets

LASHING PLATFORM HAVING A MAGAZINE FOR TWISTLOCKS

CROSS-REFERENCE TO RELATED APPLICATIONS

This application represents a National Stage application of PCT/DE2010/000575 entitled "Lashing Platform Having a Magazine for Twistlocks" filed May 26, 2010, pending.

BACKGROUND OF THE INVENTION

The invention relates to a lashing platform comprising a base frame, a setting plate resiliently supported on the base frame, a plurality of screwing devices for inserting twistlocks into container fittings or removing twistlocks from container fittings, a plurality of magazines for accommodating the twistlocks, and a plurality of transfer devices for transferring a twistlock from a magazine to a screwing device or from a screwing device to a magazine.

Lashing platforms are known in various designs. They exhibit a setting plate for accommodating one or more containers and screwing devices of differing designs for removing twistlocks from the container fittings or inserting twistlocks into the container fittings.

The advantage of a lashing platform consists in the fact that the action of inserting and removing the twistlocks, that is otherwise carried out manually and that necessitates considerable safety requirements to avoid accidents, is carried but automatically; the workers not being in the danger zone of the container and thus more relaxed safety requirements being applied. The containers can thus be transferred in less time.

A lashing platform of particularly advantageous design is for example known from WO 2007/098749 A1. It features a setting plate for containers that can be lowered, wherein on lowering the plate, gas reservoirs arranged below the setting plate being compressed by the container set down thereon and the compressed gas being fed to a compressed-air reservoir. The energy stored in the compressed-air reservoir can then he made available for driving the lashing platform.

The lashing platform known from WO 2007/098749 A1 can thus be operated as an independent system without any supply lines.

In particular WO 2007/098749 A1 suggests a lashing platform that can accommodate either a 20' container, two 20' containers in twin operation, or a 40' container (20' or 40'=20 feet resp. 40 feet).

A disadvantage of this platform however is that differently sized containers, e. g. a 45'container, cannot be accommodated by this lashing platform or processed with it.

In contrast RAM (Singapore) is known to have the lashing platform RAM 4000 for accommodating a 20' container, two 20' containers in twin operation, and a 40'container, in addition it being possible to set down also a 45' container on the lashing platform. Using this known lashing platform the most common container sizes can be handled.

However a disadvantage of this solution is that a 45' container can only be set down on the platform but cannot be freed from the twistlocks automatically or provided with them. Rather a 45' container projects over the dimensions of these known lashing platforms so that the twistlocks must further be removed manually from the container fittings or inserted into them. This again gives rise to a potentially risky work situation for the lashing workers.

In addition the 45'containers are only insufficiently secured on the lashing platform, that is only on their long sides, and projects over the lashing platform which is problematic in terms of safety aspects, e. g. for the quayside traffic.

Even though from DE 103 01 197 A1 a lashing platform consisting of four container parts is known, it being possible to move the container parts relative to one another in the longitudinal direction to enable adaptation to different container sizes. However a lashing platform of variable size presents a further safety risk for the personnel working at ground level.

SUMMARY OF THE INVENTION

It is therefore the objective of the invention to provide lashing platform that can be used to handle different container sizes automatically, also in twin operation, i. e. can be prepared for transport. In particular removing the twinlocks from the fittings of the containers or inserting them therein is to take place automatically without any workers having to be in the immediate vicinity of the container and without the lashing platform representing a safety risk for the personnel working at ground level.

The basic idea of the invention is to provide at least two units which are each formed by at least two screwing devices, at least one transfer device and at least one magazine and which can be moved relative to each other in the longitudinal direction of the lashing platform within the base frame. To this end the base frame is already equipped for accommodating a maximum container size, e. g. a 45' container, without the container projecting over the base area of the lashing platform.

Due to the fact that the lashing platform can be moved within the base frame it is possible to adapt it to different container sizes. In particular by moving the units care is taken to bring the screwing devices to the position of the container fittings that each depends on the container size, that as a rule are designed as corner fittings. To this end at least one drive for moving the units and a controller acting on the drive are provided.

In particular by controllably moving the unit it is to be achieved that the units can be arranged relative to each other such that the screwing devices of the units can access the container fittings of one 20' container, of two 20' containers in twin operation, a 40' container, or a 45' container.

Due to the fact that no change in size of the lashing platform takes place externally, the lashing platform can be placed securely without the staff doing the lashing work being taken by surprise by sudden changes in size of the lashing platform or projecting containers. Working with containers is thus made even safer.

BRIEF DESCRIPTION OF THE DRAWINGS

The invention is explained in more detail using a particularly preferred exemplary embodiment shown in the figures, in which.

DETAILED DESCRIPTION OF THE INVENTION

Figure 1:
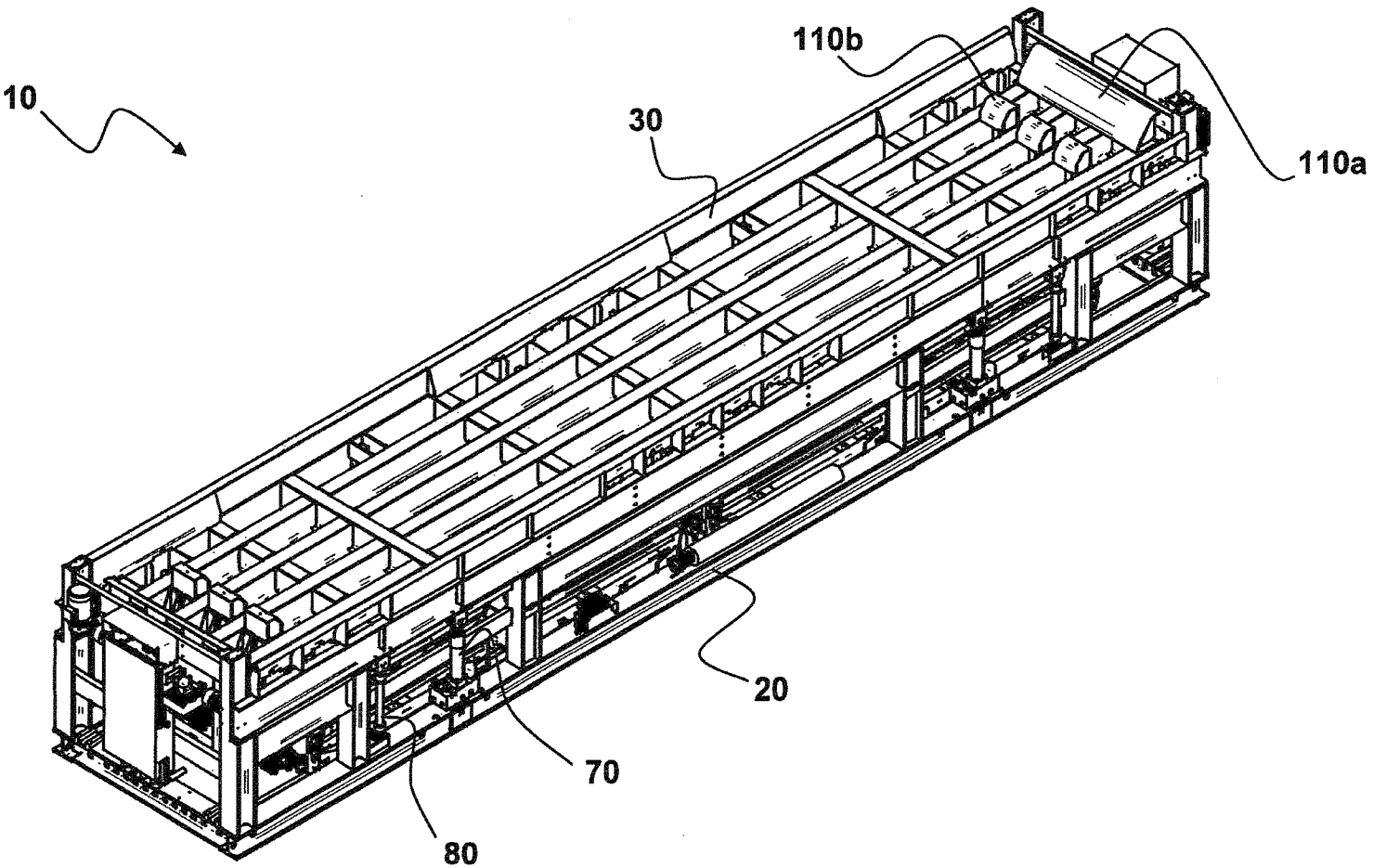
FIG. 1 shows a perspective view of the lashing platform according to the invention.

FIG. 1 shows the inventive lashing platform in a particularly preferred design in a perspective view. The lashing platform 10 consists of abase frame 20 and a setting plate 30 resiliency supported thereon. The setting plate 30 has on its upper side in the area of its end faces so-called guides 110*a*, 110*b*, the inside guides 110*b* being designed to be sunk in the setting plate, i. e. folded away. The guides serve to guide the container or containers in predetermined positions in which the units or their screwing devices can move against the container fittings above them.

Figure 3:
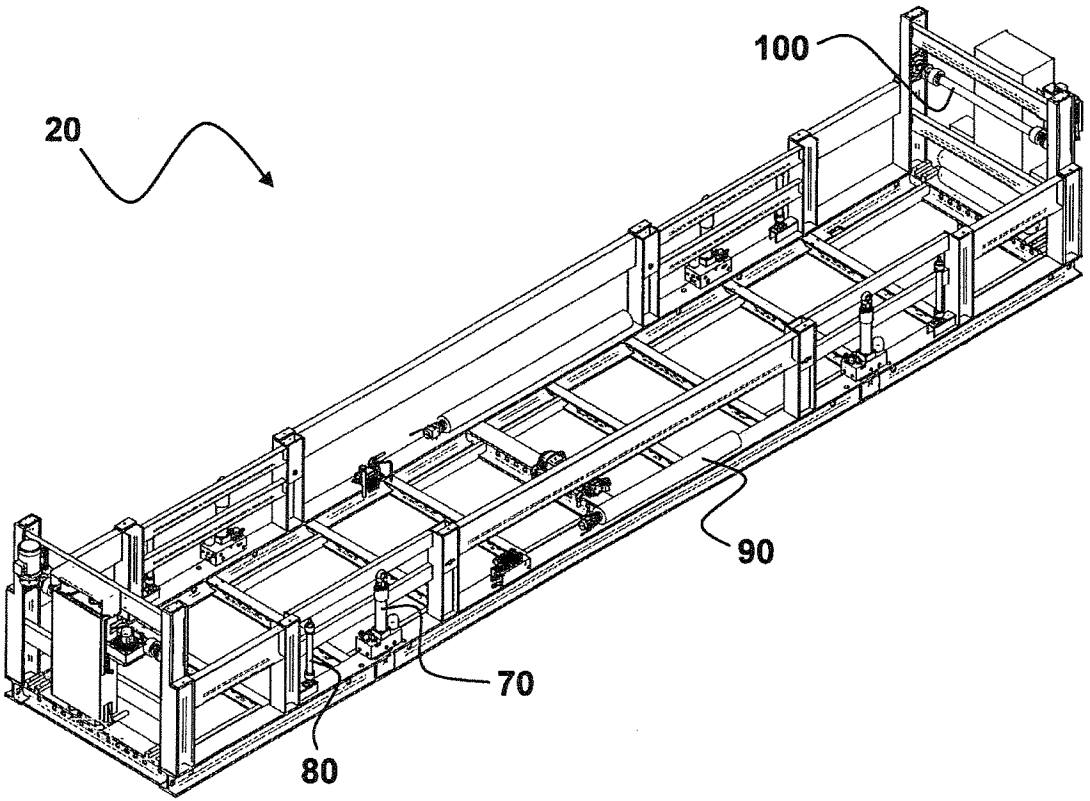
FIG. 3 shows a perspective view of the base frame of the lashing platform from FIG. 1.
Figure 4:
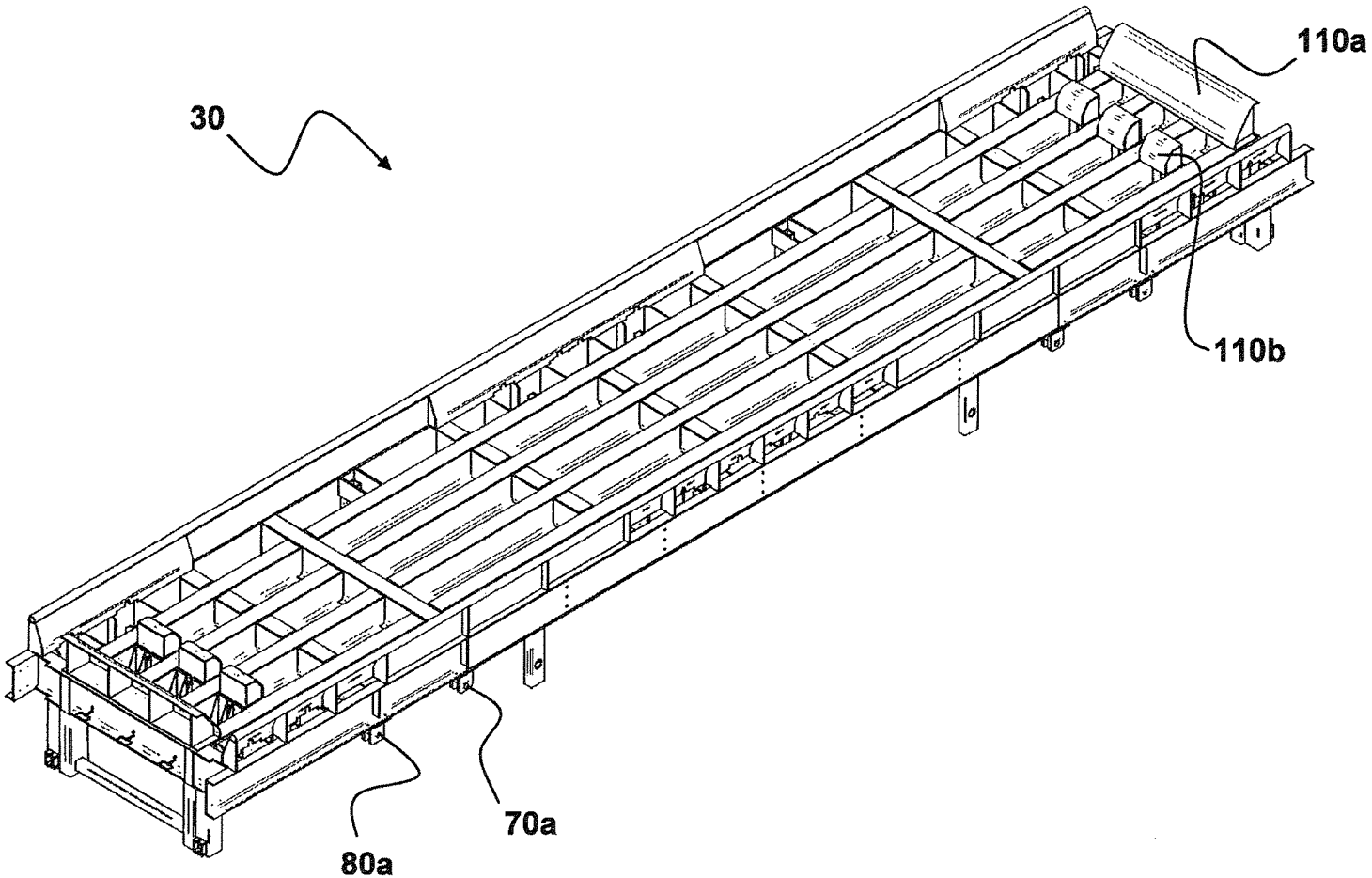
FIG. 4 shows a schematic perspective view of the setting plate of the lashing platform from FIG. 1.

The base frame 20 shown in FIG. 3 is connected via a pump cylinder 70 and lifting cylinder 80 to the setting plate 30 shown in FIG. 4 (references 70*a* and 80*a* characterize the counter bearing, disposed on the setting plate 30, of the pump or lifting cylinder 70, 80). The pump cylinders 70 serve—as is known—to generate energy when setting down the container on the setting plate 30 and the following lowering of the setting plate 30 onto the base frame 20. The lifting cylinders 80 serve to bring the setting plate 30 again into its starting position after removing the container from the setting plate 30, in which again a container can be set down.

For storing the compressed gas, the pump cylinders 70 are connected via a duct each to at least one gas reservoir device 90, it being particularly preferred that for operating the drive for moving the units, the gas reservoir device 90 is connected to the drive of the units via at least one duct.

In addition a pump cylinder controller is preferably provided that acts on the pump cylinders that enables a container to be lowered uniformly in the longitudinal direction of lashing platform 10. This takes place in that a valve controller forces a uniform increase in pressure in all cylinders. Particularly preferably the valve controller provides for the pump cylinders that lie opposite in the longitudinal direction to lower uniformly so that tilting of the setting plate 30 relative to the base frame 20 in the longitudinal direction of the lashing platform 10 can be prevented.

To prevent a tilting of the setting plate 30 relative to the base frame 20 in the transverse direction of the lashing platform 10 it is provided that synchronization systems 100 are arranged on the two end faces of the lashing platform 10 (see FIG. 3).

Figure 2:
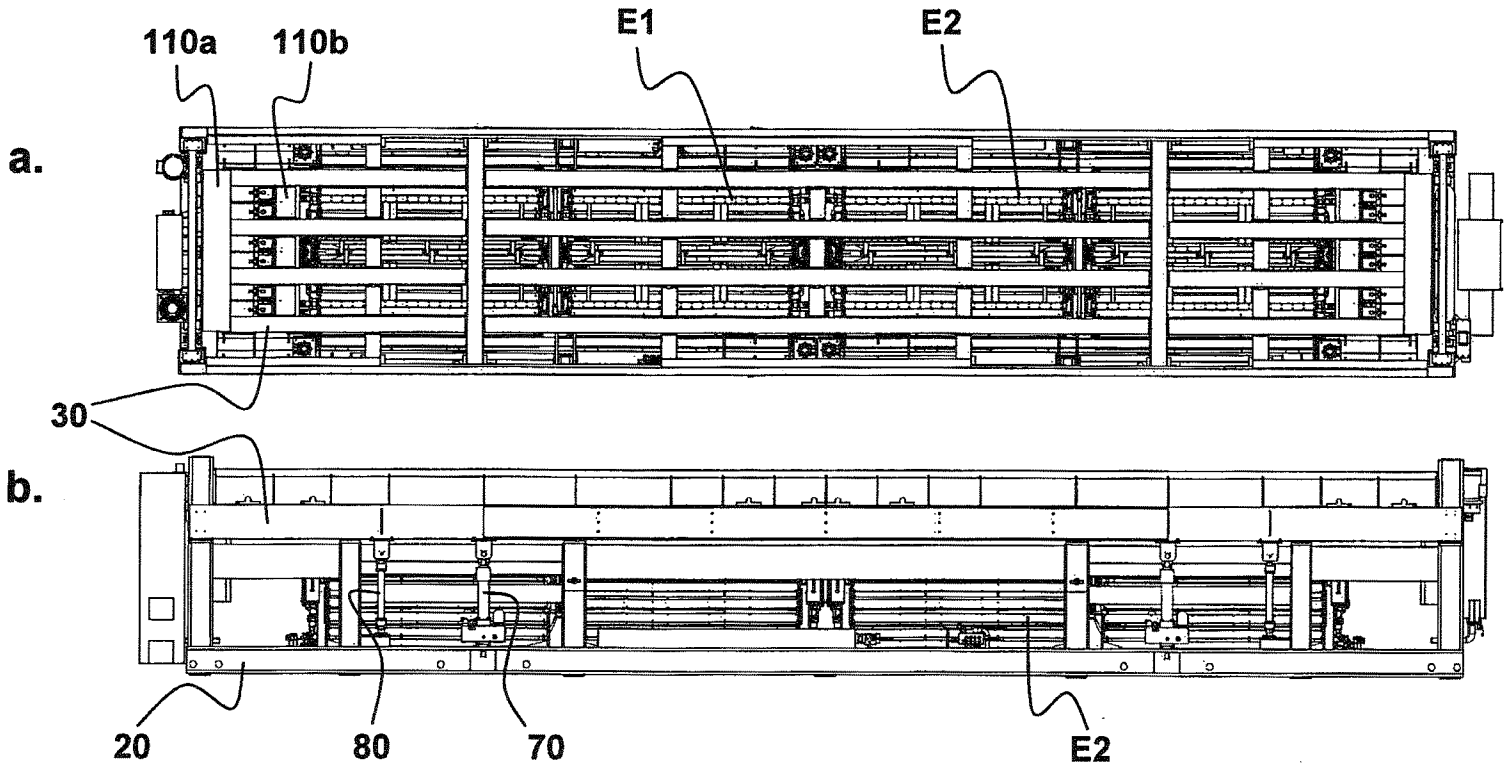
FIG. 2 shows a top view (a) and a side view (b) of the: lashing platform from FIG. 1.

As can be gathered from FIG. 2, units E1, E2 that can be moved relative to each other in the longitudinal direction are arranged between the base frame 20 and the setting plate 30 in the example 2 that is shown.

Figure 5:
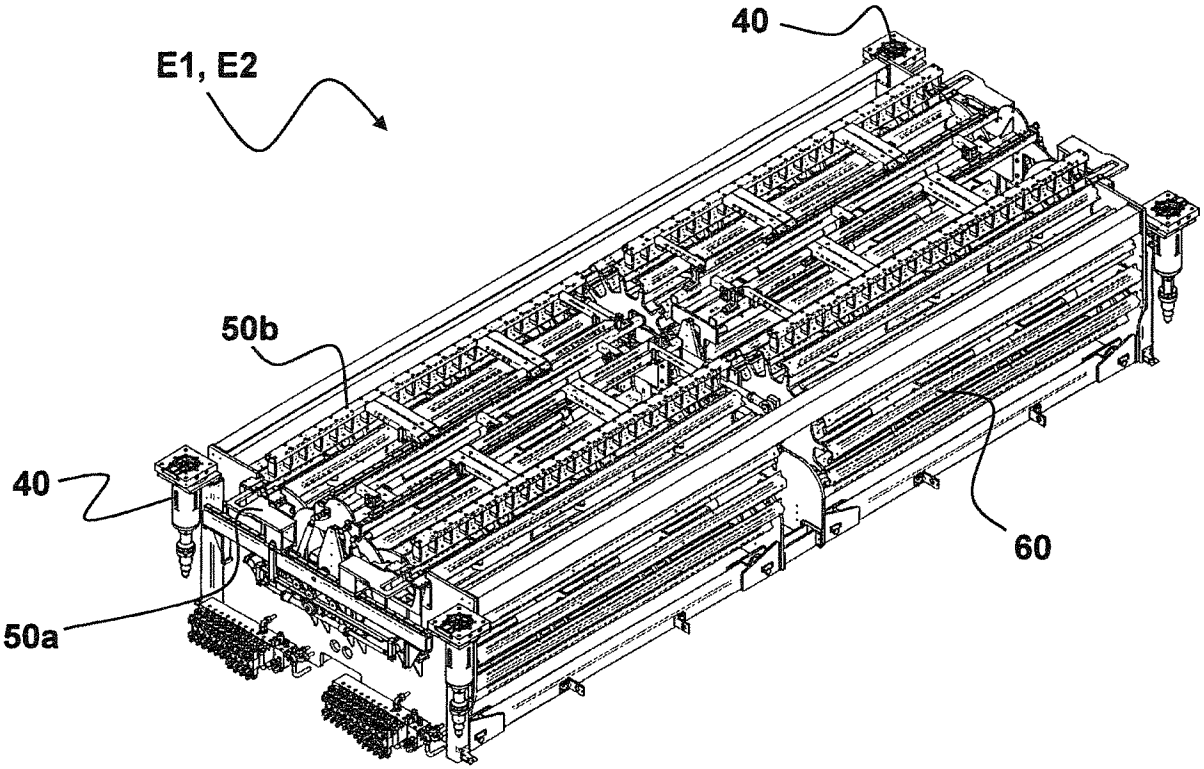
FIG. 5 shows a perspective view of a unit of the lashing platform formed by screwing devices, transfer device, and magazine, from FIG. 1.

As can be seen in FIG. 5 they each preferably consist of four screwing devices disposed in their corners, one transfer device 50*a*, 50*b* each arranged on its end face and one magazine 60 each arranged on a transfer device 50*a*, 50*b*.

Figure 6:
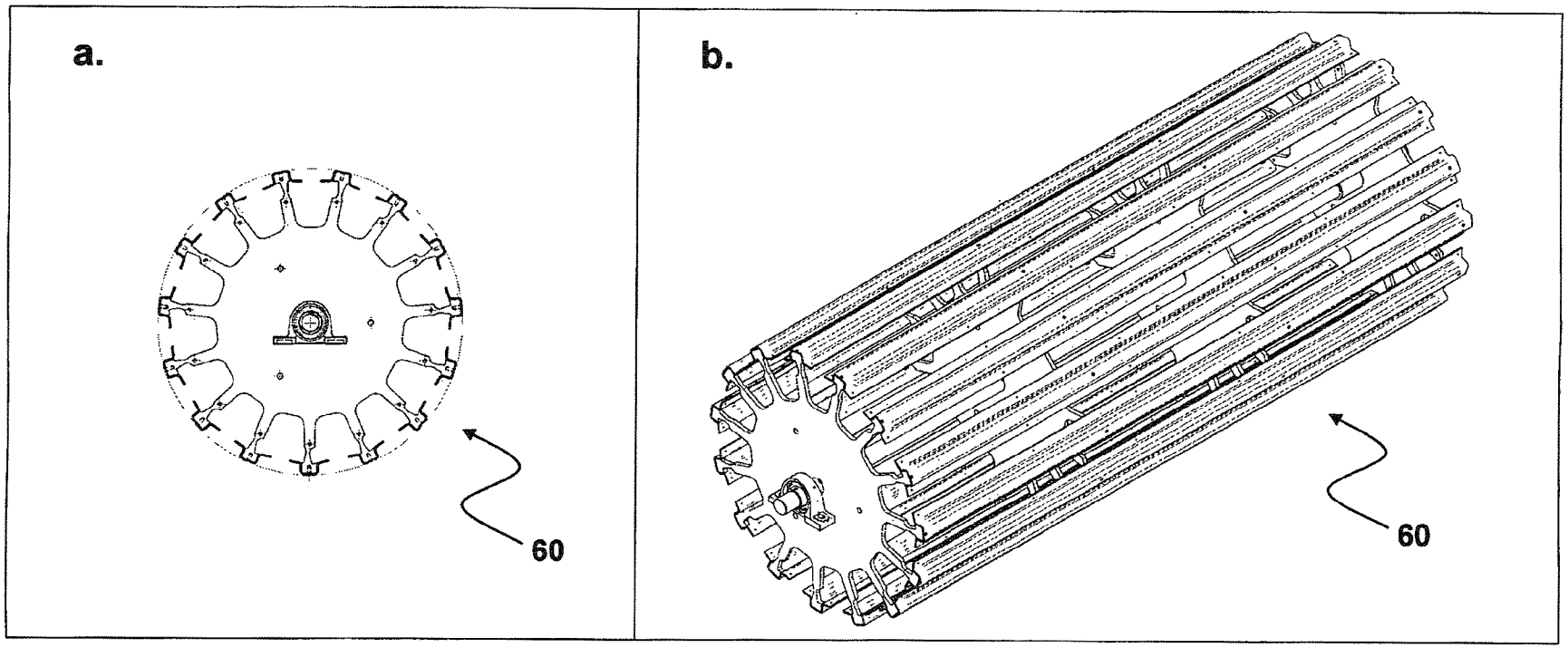
FIG. 6 shows a side view (a) and a perspective view (b) of the magazine of the lashing-platform from FIG. 1.

The magazine 60 shown in FIG. 6 is preferably designed as a drum, the drum exhibiting rails that are supported in the longitudinal direction of the drum and form a plurality of interspaces running in the longitudinal direction of the drum and in which the twistlocks can be accommodated. To this end the twistlocks are pushed in their locked position onto the rails so they are stored suspended in the magazine 60.

Preferably the magazine 60 exhibits clamping rails that support the twistlocks in predetermined positions such that they are clamped fast. To this end the clamping rails are made from an elastic material, but in addition or as an alternative can also be resiliently supported. In a particularly preferred manner, between the positions predetermined for supporting the twistlocks, the clamping rails exhibit protrusions that limit the positions so that the twistlocks are being prevented from being displaced laterally.

For pushing the twistlocks into the magazine 60 the lateral boundaries of the drum exhibit radially extending bulges so that the twistlocks can be pushed into the magazine from the side.

Figure 7:
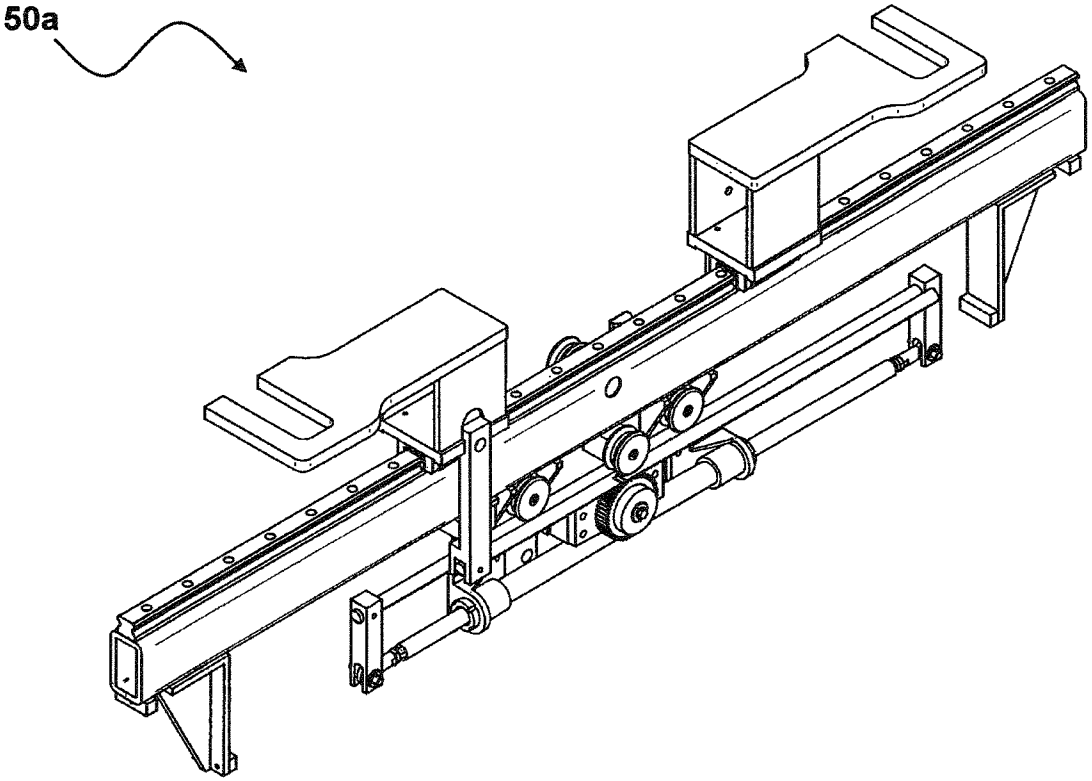
FIG. 7 shows a perspective view of a first component forming the transfer device, that is of the transport device.

FIG. 7 shows the transport device 50*a* of the transfer device 50 using which the twistlocks are transported by the screwing device 40 into the magazine 60 or from the magazine 60 into the screwing device 40.

After removing a twistlock from a container, the transport device 50*a* is moved to the screwing device 40, the legs of the U-shaped bulge of the transport device 50*a* being positioned next to the twistlock. Then the twistlock is locked again so that the transport device 50*a* can lift the twistlock out of the screwing device 40.

The twistlock is then guided to the upper lateral bulge of the magazine and pushed into the magazine 60 using the rake 50*b* that is shown subsequently and is part of the transfer device 50.

The other way round, the rake 50*b* transfers a twistlock from the magazine 60 into the U-shaped bulge of the transport device 50*a*, after which the latter places the twistlock in the screwing device 40. The screwing device 40 unlocks the twistlock, after which the transport device 50*a* becomes free again and can move back into its waiting position.

Figure 8:
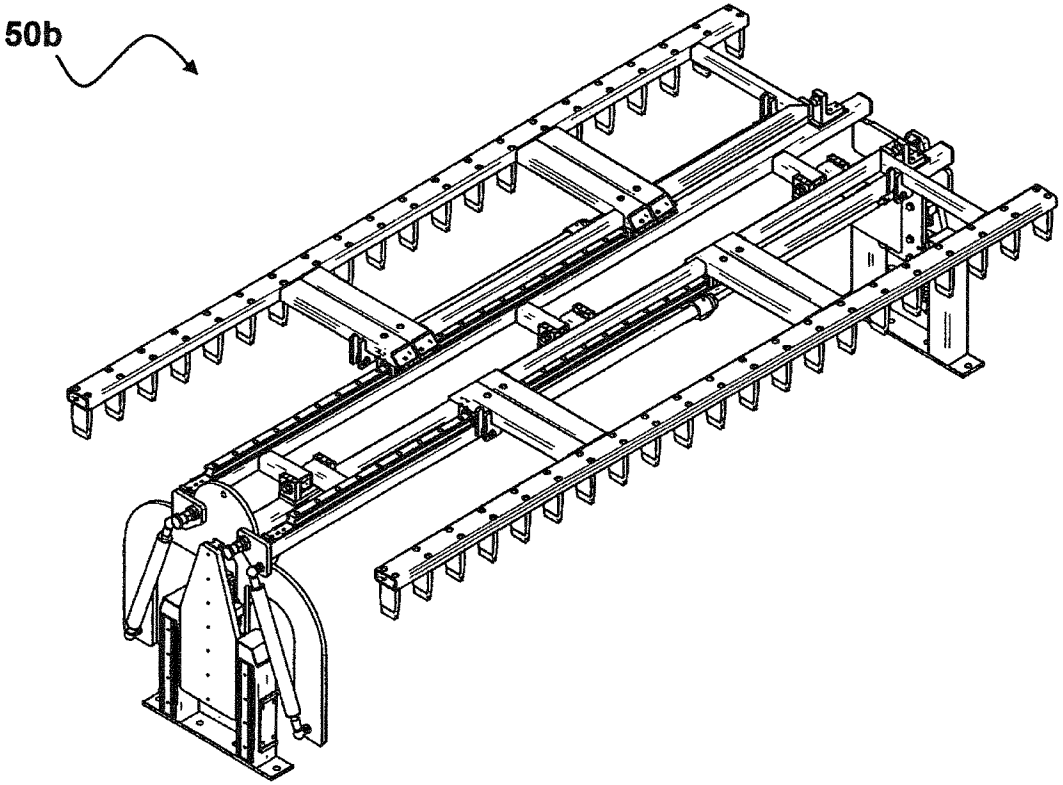
FIG. 8 shows a perspective View of a second component, forming the transfer device, that is of the rake.

The transfer of the twistlocks from the transport device 50*a* into the magazine 60 takes place, as previously described, by the rake 50*b* shown in FIG. 8. The rake 50*b* preferably exhibits a plurality of tines that are spaced apart relative to each other with the spacing of the interspaces between the storage positions, provided in the magazine 60, of the twistlocks. This achieves the situation that it is not only one twistlock that is pushed into the magazine 60 and out of it again, but that all twistlocks that are supported suspended in the magazine 60 are moved synchronously when being inserted into the magazine 60 or when being taken out of the magazine—that is, the rake 50*b* is thus always displaced only by one position of a twistlock storage location. This avoids the situation that the twistlocks become entangled and/or are damaged.

It is particularly preferred that the tines of the rake 50*b* have a tapered design at their ends. On the one hand this simplifies inserting the rake 50*b* into the interspaces of the magazine, in addition it being achieved when the magazine 60 is designed with clamping rails, that the clamping rails being are apart, it being easier to move the twistlocks when loading or unloading the relevant clamping rails since the clamping rails are pushed apart by inserting the rake 50*b*.

It is appreciated that the magazine 60, in its design shown here, can also be utilized in conventional lashing platforms without the particular design of the lashing platform 10 shown here being of any importance.

Finally the lashing platform 10 preferably exhibits sensors acting on the controller to move the units E1, E2 for detecting the size of a container that is to be set down or has been set down onto the lashing platform. Here the controller in addition or as an alternative detects the number of containers that are to be set down or have been set down onto the/lashing platform.

Further if is also possible to make provisions for conclusions to be drawn regarding the weight of the container from its size so that corresponding presettings can be made regarding the energy that is to be expected to be gained or regarding the counterbalance of the container on the lashing platform.

The invention claimed is:

1. A lashing platform comprising a base frame, a setting plate resiliently supported on the base frame, a plurality of screwing devices for inserting twistlocks into container fittings or removing twistlocks from container fittings, a plurality of magazines for accommodating the twistlocks, and a plurality of transfer devices for transferring a twistlock from a magazine to a screwing device or from a screwing device to a magazine, characterized by at least two units, which are each formed by at least two screwing devices, at least one transfer device, and at least one magazine and which can be moved relative to each other in the longitudinal direction of the lashing platform within the base frame, at least one drive for moving the units, and a controller for moving the units into positions in which, with a fixed lashing platform size, the screwing devices have access to the container fittings of containers of different size.

2. The lashing platform according to claim 1, characterized in that the positions of the units may accommodate a 20' container, two 20' containers, a 40' container, or a 45' container.

3. The lashing platform according to claim 1, characterized in that the units are formed by in each case four screwing devices, two transfer devices, and a magazine.

4. The lashing platform according to claim 1, characterized by pump cylinders that are arranged on the long sides of the lashing platform and connect the base frame to the setting plate, that are connected to at least One gas reservoir device via a duct each for storing compressed gas.

5. The lashing platform according to claim 4, characterized in that the drive of the units is operated using energy provided from the gas reservoir device.

6. The lashing platform according to claim 4, characterized by a pump cylinder controller acting on the pump cylinders for uniformly lowering a container.

7. The lashing platform according to claim 6, characterized in the pump cylinder controller is arranged for preventing a tilting of the setting plate relative to the base frame in the longitudinal direction of the lashing platform.

8. The lashing platform according to claim 1, characterized by hydraulic lifting cylinders, that are arranged on the long sides of the lashing platform and connect the base frame to the setting plate, for lifting the setting plate into the starting position.

9. The lashing platform according to claim 1, characterized by synchronization systems arranged on both end faces of the lashing platform for preventing a tilting of the setting plate relative to the base frame in the transverse direction of the lashing platform.

10. The lashing platform according to claim 1, characterized by sensors acting on the controller for detecting the size of a container that is to be set down or has been set down onto the lashing platform.

11. The lashing platform according to claim 1, characterized by sensors acting on the controller for detecting the number of containers that is to be set down or has been set down onto the lashing platform.

12. The lashing platform according to claim 1, characterized in that the transfer device is formed from a transport device for transporting a twistlock from a screwing device to the magazine or from the magazine to the screwing device and a rake pushing the twistlock out of the transport device into the magazine or pushing the twistlock out of the magazine into the transport device.

13. The lashing platform according to claim 12, characterized in that the rake exhibits plurality of tines that are spaced apart by a spacing of the interspaces between the storage positions provided in the magazine, of the twistlocks relative to each other.

14. The lashing platform according to claim 12, characterized in that the tines of the rake have a tapered design at their free ends.

15. The lashing platform according to claim 1, characterized in that the magazine is designed as a drum.

16. The lashing platform according to claim 1, characterized in that the magazine exhibits clamping rails that support the twistlocks at predetermined positions.

17. The lashing platform according to claim 16, characterized in that The clamping rails are made from an elastic material.

18. The lashing platform according to claim 16, characterized in that the clamping rails are resiliently supported.

19. The lashing platform according to claim 16, characterized in that between the positions predetermined for supporting the twistlocks, the clamping rails exhibit protrusions that limit the positions.

* * * * *